US005600286A

United States Patent [19]

Livingston et al.

[11] Patent Number: 5,600,286

[45] Date of Patent: Feb. 4, 1997

[54] END-ON TRANSMISSION LINE-TO-WAVEGUIDE TRANSITION

[75] Inventors: Stan W. Livingston, Fullerton; Jar J. Lee, Irvine, both of Calif.

[73] Assignee: Hughes Electronics, Los Angeles, Calif.

[21] Appl. No.: 315,008

[22] Filed: Sep. 29, 1994

[51] Int. Cl.[6] ..... H01P 5/107

[52] U.S. Cl. ..... 333/26; 333/33

[58] Field of Search ..... 333/26, 33; 343/767

[56] References Cited

U.S. PATENT DOCUMENTS

| | | | |
|---|---|---|---|
| 4,425,549 | 1/1984 | Schwartz et al. | 329/161 |
| 4,843,403 | 6/1989 | Lalezari et al. | 343/767 |
| 4,905,013 | 2/1990 | Reindel | 343/786 |
| 5,081,466 | 1/1992 | Bitter, Jr. | 343/767 |
| 5,095,292 | 3/1992 | Masterton | 333/26 |
| 5,278,575 | 1/1994 | Thomas | 333/26 |

FOREIGN PATENT DOCUMENTS

| | | | |
|---|---|---|---|
| 3724945 | 2/1989 | Germany | 333/26 |
| 213201 | 8/1990 | Japan | 333/26 |
| 660128 | 5/1979 | U.S.S.R. | 333/33 |

OTHER PUBLICATIONS

Deshpande, "Analysis of an End Launcher for an X–Band Rectangular Waveguide", *IEEE Transactions on Microwave Theory and Techniques*, vol. MTT–27, No. 8, Aug. 1979, pp. 731–735.

Ponchak, "A New Model for Br9oadband Waveguide–to–Microstrip Transition Design", *Microwave Journal*, May 1988, pp. 333–343.

Bawer, "A Printed Circuit Balun for Use with Spiral Antennas", *IRE Transactions on Microwave Theory and Techniques*, May 1960, pp. 319–325.

*Primary Examiner*—Benny T. Lee

*Attorney, Agent, or Firm*—Michael W. Sales; Wanda K. Denson-Low

[57] ABSTRACT

A transmission line-to-waveguide transition that includes a microstrip impedance transformer for matching the impedance of an input transmission line to that of a flared slotline is disclosed. The slotline's width is sufficiently small such that when the transition is inserted into a waveguide the slotline is spaced inward from the waveguide's inner walls. A balun bi-directionally couples the unbalanced signal on the microstrip to a balanced signal on the slotline. The signal propagates along the slotline and is capacitively coupled to the waveguide. A trimmable tuning stub is used to adjust the resonant frequency of a parasitic cavity formed between the transition and the waveguide to increase the transition's effective bandwidth. A tapered dielectric insert is positioned inside the waveguide to decrease its size and to improve the coupling efficiency of the transition.

22 Claims, 4 Drawing Sheets

END-ON TRANSMISSION LINE-TO-WAVEGUIDE TRANSITION

BACKGROUND OF THE INVENTION

1. Field of the Invention

The present invention generally relates to transmission line-to-waveguide transitions, and more specifically to an end-on transition that does not contact the waveguide when inserted.

2. Description of the Related Art

Transmission line-to-waveguide transitions are used extensively in microwave communications systems such as radar and satellite systems. The systems may include a waveguide antenna for phased array applications or a conventional waveguide of arbitrary cross-section. In these systems the microwave signal is ideally bi-directionally coupled between a waveguide and a transmission line with minimal power (insertion) loss and maximum signal clarity. The transmission line can be a monolithic microwave integrated circuit (MMIC) that is wire bonded to the transition or it can be a coaxial cable.

A major source of loss in microwave systems is impedance mismatch between components. The mismatch causes a significant portion of the signal to be reflected at their junction. Therefore, matching the impedances of the components is very important for reducing the transition's insertion loss.

A common end-on transition between a coaxial cable and a waveguide is described by Deshpande, "Analysis of an End Launcher for an X-Band Rectangular Waveguide", *IEEE Transactions on Microwave Theory and Techniques,* Vol MTT-27, No. 8, August 1979, pp. 731–735. The transition is formed by bending the cable into an L-shaped loop, grounding its outer conductor and attaching (welding) its center conductor to the waveguide. The direct contact between the transition and the waveguide makes the transition's impedance difficult to calculate. It is difficult to design the dimensions of the loop to provide a wide bandwidth with low insertion loss while maintaining tight enough manufacturing tolerances to achieve the designed bandwidth. Furthermore, forming a high quality contact between the coax and waveguide adds substantially to the manufacturing cost of the transition.

Another type of transition is the antipodal finline disclosed by Ponchak, "A New Model for Broadband Waveguide-to-Microstrip Transition Design", *Microwave Journal,* May 1988, pp. 333–343. In this transition, finline conductors on opposing sides of a substrate form a high quality contact with the waveguide's inner walls. As a result, the conductors require unusual and complicated cross sectional designs to efficiently couple the signals between the waveguide and the microstrip. A semicircular fin is positioned next to one of the finlines to adjust the resonant frequency of the transition.

An external dipole transition to a ridge waveguide is disclosed in U.S. Pat. No. 5,095,292 to Masterton. The dipole coupling must be at least 0.5 wavelengths in size and is restricted to ridge waveguides. The dipole coupling is prohibitively large for phased antenna arrays, which typically have center-to-center spacings less than 0.5 wavelengths. U.S. Pat. No. 4,905,013 to Reindel describes a finline horn antenna that includes a finline dipole radiator extending a quarter-wave out from an open ended waveguide. The finline slot forms a high quality contact with the waveguide. U.S. Pat. No. 4,425,549 to Schwartz discloses conductive finlines disposed on opposite surfaces of a dielectric substrate and in direct contact with the inner walls of a rectangular waveguide. A diode that connects the opposing finlines is used to couple RF signals in the waveguide to a filter. A balun for directly coupling microwave signals between a spiral antenna and a transmission line is described by Bawer, "A Printed Circuit Balun for Use with Spiral Antennas", *IRE Transactions on Microwave Theory and Techniques,* May 1960, pp. 319–325.

In all of the transmission line-to-waveguide transitions except Masterton's external dipole, the slotline or finline is permanently attached to the inner walls of the waveguide to form a high quality mechanical and electrical contact. Welding the transition directly to the waveguide is a difficult and expensive process. It is difficult to manufacture the contact with the tight tolerances and quality required to achieve a large bandwidth with low insertion loss.

The transition and waveguide which it contacts form a three dimensional system that is very difficult to model, one reason being that the charge density does not uniformly decrease away from the slotline's inner surfaces. Instead the charge tends to accumulate at the transition-waveguide contacts, which greatly increases the complexity of the impedance computations. Furthermore, the bandwidth (10%–15% of the center frequency), insertion losses and the tuning of the resonant frequencies in the waveguide are not optimum.

SUMMARY OF THE INVENTION

The present invention provides a compact, low loss, high bandwidth end-on transmission line-to-waveguide transition that is easier to design and less costly to manufacture than prior transitions.

This is accomplished with a microstrip of which a portion is an impedance transformer that matches the impedance of an input transmission line to that of a flared slotline. The width of the slotline is small enough that, when the transition is inserted into a waveguide, the slotline is spaced inward from the waveguide's inner walls. A balun bi-directionally couples the unbalanced signal on the microstrip to a balanced signal on the slotline. The signal propagates along the slotline and is capacitively coupled to the waveguide. A trimmable tuning stub is used to adjust the resonant frequency of a parasitic resonant cavity formed between the waveguide and the transition to increase the transition's effective bandwidth. A tapered dielectric insert can be positioned inside the waveguide to reduce its size and to improve the coupling efficiency of the transition.

For a better understanding of the invention, and to show how the same may be carried into effect, reference will now be made, by way of example, to the accompanying drawings.

DETAILED DESCRIPTION OF THE INVENTION

Figure 1:
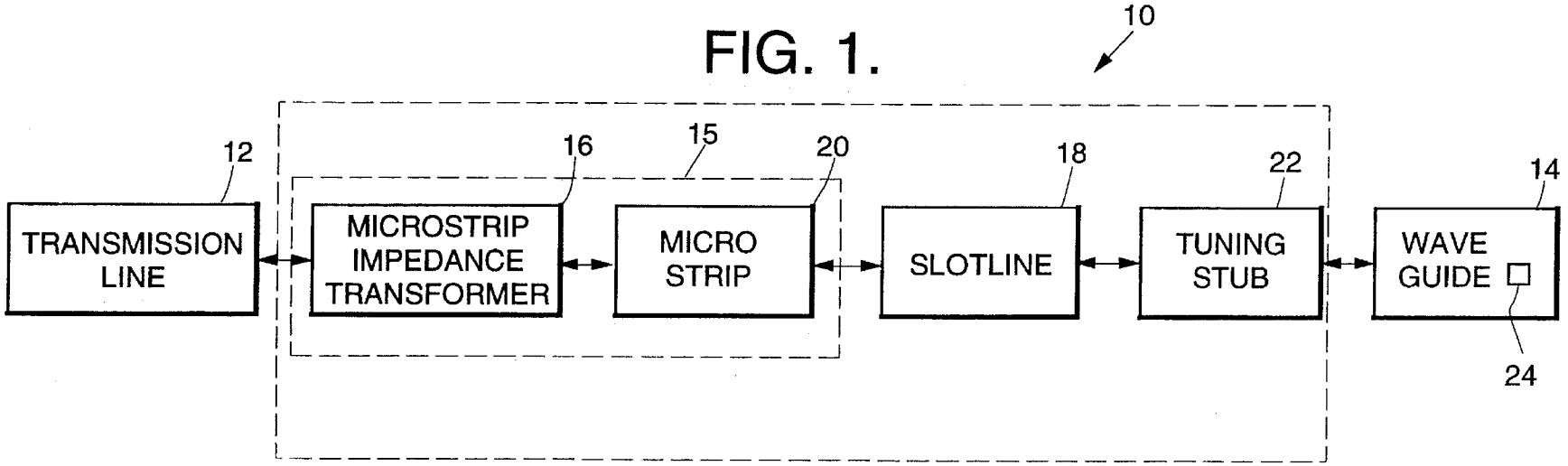
FIG. 1 is a block diagram of a transmission line, a transmission line-to-waveguide transition and a waveguide in accordance with the invention.

FIG. 1 is a block diagram of a transmission line-to-waveguide transition 10 for bi-directionally coupling a transmission line 12 to a waveguide 14. The transmission line can be a coaxial cable or a monolithic microwave integrated chip (MMIC) chip that is wire bonded to the transition. Typical waveguides are either circular, semi-circular or rectangular, have a characteristic impedance and transmit/receive a modulated electric field $\vec{E}$. They can also be described as transmitting/receiving modulated and equal but opposite currents on the opposed conductors in the transmission line or the opposed inner walls of the waveguide.

The transition includes an unbalanced microstrip 15 of which a portion is an impedance transformer 16 between the transmission line 12 and a slotline 18. The transformer 16 matches the line's impedance to that of the slotline 18 to reduce the portion of the signal that is reflected from the microstrip-to-slotline coupling, i.e., insertion losses. A balun 20 bi-directionally couples signals from the unbalanced microstrip 15 to the balanced slotline 18. The slotline's impedance increases gradually from the balun to match the waveguide's impedance.

The slotline 18 is spaced inward from the transition's edges and its width is small enough so that, when the transition is inserted into the waveguide, the slotline does not touch the waveguide's inner walls. The transition engages the waveguide without an internal connection, thus reducing the manufacturing and design costs. One or more trimmable tuning stubs 22 are used to adjust the resonant frequency of a parasitic cavity formed by the waveguide's walls and the transition to increase the transition's effective bandwidth to approximately 20% of its center frequency.

A dielectric insert 24 is inserted into the waveguide which reduces the signal's effective wavelength, thus reducing the diameter of the waveguide and the transition. The dielectric insert is formed with an exponential taper around the transition in order to increase the efficiency of the transition.

Figure 2:
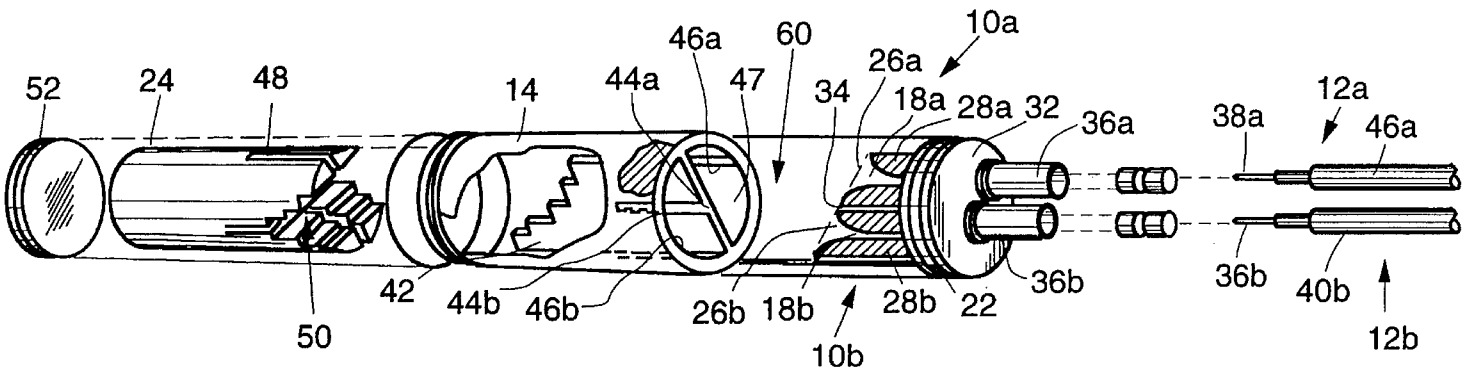
FIG. 2 is an exploded perspective view of a transmission line-to-waveguide transition shown with a pair of coaxial cables and a circular waveguide.

FIG. 2 is an exploded perspective view of a pair of transmission line-to-waveguide transitions 10*a* and 10*b* for bi-directionally coupling signals from a pair of coaxial cables 12*a* and 12*b* to a circular waveguide 14. Transition 10*a* and 10*b* respectively include low loss substrates 26*a* and 26*b* such as 3M Corporation's 2.17 Board, with layers 28*a* and 28*b* of a conductive material such as copper or gold, patterned on one side of the substrates to define exponentially flared slotlines 18*a* and 18*b* and respective tuning stubs 22. The transitions are mounted along a diameter of a circular endplate 32 with a small gap 34 between them.

The coaxial cables 12*a* and 12*b* are connected to respective connectors 36*a* and 36*b* on the other side of the circular endplate 32. The cables' center conductors 38*a* and 38*b* are connected to the transitions' impedance transformers. Their outer conductors 40*a* and 40*b* are connected to the transitions' conductors 28*a* and 28*b*.

A circularly polarizing septum 42 is mounted along an inner diameter of the waveguide 14. A pair of inner grooves 44*a* and 44*b* are formed on either side of the septum at the center of the waveguide. A pair of longitudinal outer grooves 46*a* and 46*b* are formed along the waveguide's inner walls 47 along a diameter of the waveguide that is orthogonal to the septum. The septum separates the two transitions 10*a* and 10*b* both physically and electrically. The transitions are inserted into the waveguide so that the gap 34 between them engages the pair of inner grooves 44*a* and 44*b*, and their outer edges slide into the outer grooves 46*a* and 46*b*. The outer edges of the conductive layers 28*a* and 28*b* are spaced inward from the waveguide's inner walls 47. The endplate 32 is attached to the open front end of the waveguide 14.

The dielectric insert 24, preferably formed from Teflon or Rexolite, is inserted into the waveguide 14 to reduce the signal's effective wavelength, thus reducing the diameter of the waveguide and transitions. The signal's effective wavelength is $$\lambda_g = \frac{1}{\sqrt{\epsilon_r}} \frac{\lambda_0}{\sqrt{1-(f_c/f)^2}}$$

where $\lambda_0$ is the wavelength in free space, f is the bandwidth's center frequency, $f_c$ is the cutoff frequency of the waveguide and $\epsilon_r$ is the relative dielectric constant of the insert with respect to air. A vertical slot 48 in the insert engages the seprum. An exponentially flared slot 50, generally perpendicular to the vertical slot 48, meshes with the transitions. For ease of manufacturing, the slot 50 is formed as a series of graded steps instead of a smooth flare. The flared slot's open end is positioned towards the end cap 32 and its thinly tapered closed end is formed around the ends of the transitions. Preferably, the flared insert does not contact the transition's metalization patterns. An end plate 52, which is designed to be transparent over the desired bandwidth, is attached to the open end of the waveguide.

In the transmission mode, signals propagating through the coaxial cables are coupled via transitions 10*a* and 10*b* to the waveguide 14. The signals propagate down the waveguide and are emitted through the transparent endplate 52 into free space. In the receive mode, microwave signals traveling through free space that are incident upon the waveguide propagate down the waveguide to the pair of transitions, which couple the signals through to the pair of coaxial cables.

Figure 3:
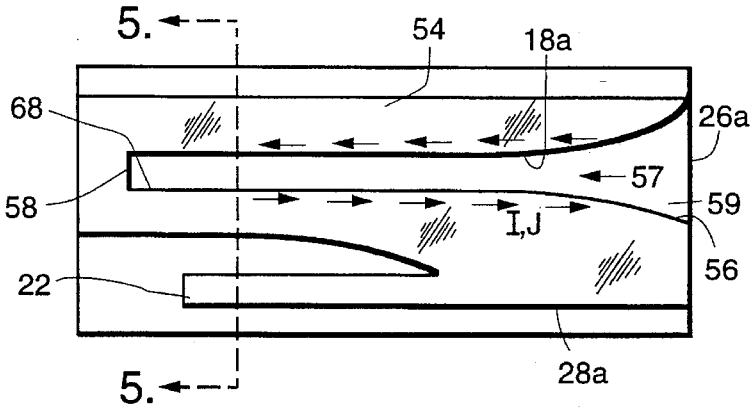
FIG. 3 is a top plan view of the transmission line-to-waveguide transition of FIG. 1, illustrating the flared slotline.
Figure 5:
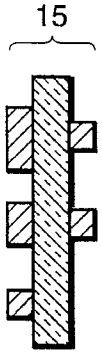
FIG. 5 is a sectional view taken along section line 5—5 of FIGS. 3 and 4.
Figure 4:
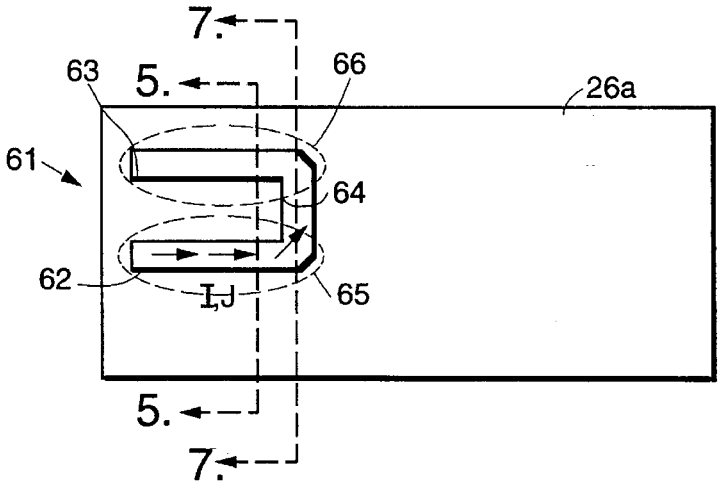
FIG. 4 is a bottom plan view of the transmission line-to-waveguide transition of FIG. 1, illustrating the U-shaped conductor.

FIGS. 3 and 4 are top and bottom plan views and FIG. 5 is an end on sectional view of the transmission line-to-waveguide transition 10*a* shown in FIG. 2. As shown in FIG. 3, the conductive layer 28*a* is patterned on the substrate 26*a* to form the exponentially flared slotline 18*a*. The slotline is a planar transmission line consisting of two coplanar conductors 54 and 56 that are approximately one wavelength in length, and separated by a finite flared gap 57. The outside edges of the conductors 54 and 56 are spaced inward from the substrate's edges so that, when the transition is inserted into the waveguide, the conductors 54 and 56 do not contact the inner walls 47 of the waveguide (see FIG. 2). One end 58 of the gap, positioned towards the end cap, is closed where the two conductors are shorted together. For a center frequency of 10 Ghz the gap flares open from a width of approximately 0.6 mm at its closed end 58 to approximately 5 mm at its open end 59. The conductors 54 and 56 are designed to provide a substantially balanced slotline impedance, and hence a substantially balanced current density, on the opposed surfaces of the slotline. The slotline's impedance at any given point is a function of the gap's width, the cross-sectional widths of the conductors and the charge densities along their surfaces.

The trimmable tuning stub 22 is formed as an extended portion of conductor 56. It is substantially parallel to the slotline and is laterally spaced from the conductor towards the closed end of the slotline. The tuning stub can be trimmed to adjust the resonant frequency of a parasitic cavity 60 (see FIG. 2) formed by the waveguide and the transition. With an appropriate trimming of the stub, the transition's useful bandwidth can be increased to approximately 20% of the center frequency, i.e., $$\text{bandwidth} = \frac{f_H - f_L}{f_C}$$

where $f_L$, $f_C$, $f_H$ are the lower, center and upper frequencies of the bandwidth, respectively. For example, the stub can be trimmed using a knife such as an Exacto knife.

As shown in FIG. 4, a U-shaped conductor 61 is formed on the other side of substrate 26*a* in alignment with conductors 54 and 56 (see FIG. 3) to create the microstrip 15 (see FIG. 5); the conductor's open end 59 (see FIG. 3) is positioned towards the endplate 32 and its closed end 58 traverses the slotline. The U-shaped conductor 61 includes two opposing legs 62 and 63 that are connected by a base 64 at its closed end. The microstrip 15 is unbalanced because its opposed conductors 61 and 54, 56 have unequal cross-sectional areas that conduct unbalanced current densities J. The current I on the conductors are equal in magnitude and opposite in sign but the densities are different.

A first quarter-wave portion 65 of the U-shaped conductor 61 includes leg 62 and half of base 64. The quarter wave portion 65 and the conductor 54 collectively form the microstrip impedance transformer (16 in FIG. 1). The portion 65 is connected to the coaxial cable's center conductor 38*a* (see FIG. 2) and matches the cable's impedance to that of the slotline at a point one-quarter of a wavelength from the slotline's closed end 58. Alternatively, the portion 65 can be a tapered line with impedance $z=z_0\, e^{px}$ where $z_o$ is the coaxial cable's impedance, and x is measured from the connection of the coax and the transition (x=0) to the point where the line intersects the slotline. The variable p is selected so that the tapered line's impedance is matched to the slotline's impedance.

A second quarter-wave portion 66 of the U-shaped conductor 60 includes leg 63 and the other half of base 64. The portion 66 and the conductor 56 collectively form a microstrip quarter-wave open circuit (67 in FIG. 6). The balun (20 in FIG. 1) includes the open circuit 67 and a quarter-wave portion 68 of the slotline between its closed end 58 and the base 64. The signal current at the open end of the open circuit 67 is zero, and hence a quarter wave-length back from the open circuit the current will be a maximum. Thus a maximum amount of current is coupled to the slotline. An electrically equivalent approach would be to remove portion 66 and short circuit the conductor 61 through the substrate to the conductor 54.

In the prior art, the transition's precise geometric design is accomplished by modeling the characteristic impedances of the transmission line and waveguide, and the dimensions of the waveguide. The impedances of the various components are matched to maximize the transition's bandwidth and minimize its insertion losses. The pattern design process is simplified substantially by constructing the transition so that its conductors 54 and 56 are spaced inward from the waveguide's walls, thereby electrically isolating the waveguide and the slotline at this cross-section. This reduces the design problem from one of solving the transverse electric (TE) and transverse magnetic (TM) modes inside the waveguide to one of solving the TEM characteristic impedance of the slotline.

Figure 6:
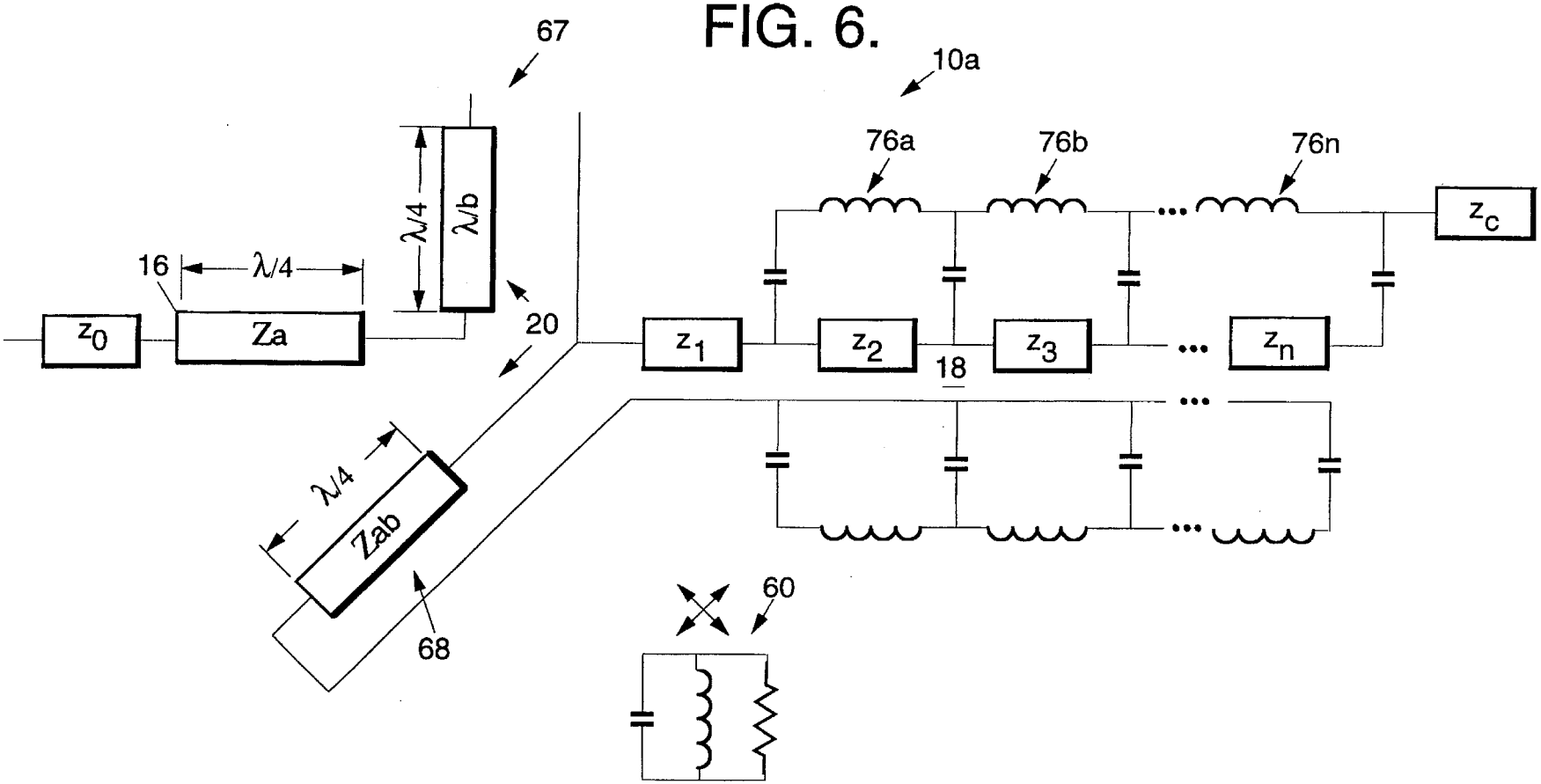
FIG. 6 is a schematic diagram of an equivalent circuit for the transmission line-to-waveguide transition of the present invention.

FIG. 6 is a schematic diagram of an equivalent circuit for the transmission line-to-waveguide transition 10*a*. A transmitted signal is input to the microstrip quarter-wave transformer 16. The portion of the signal reflected back from the slotline is reduced by setting the impedance of the transformer equal to $Z_a=\sqrt{Z_0 Z_1}$, (where $Z_0$ is the coax's impedance and $Z_1$ is the slotline's impedance) at the point where the balun traverses the slotline. The balun 20 couples the unbalanced signal on the microstrip to the balanced slotline 18. A forward signal is directly coupled to the slotline, with one portion of the signal traveling down the quarter-wave open circuit 67 and another portion propagating down the quarter-wave slotline 68. Ideally, the signals reflected from the open circuit and the closed end of the slotline reinforce the forward signal so that entire input signal is coupled through to the slotline.

To minimize losses associated with the balun 20, the impedance $Z_b$ of the conductor's quarter-wave ($\lambda/4$) open circuit portion 67 is set equal to $Z_a$ so that the current at the slotline is maximum, and the slotline's quarter-wave ($\lambda/4$) segment 68 is designed so that its impedance $Z_{ab}=Z_1$. The flared slotline is modeled by a series of N RLC circuits 76*a*, 76*b*. . . 76*n* whose impedances gradually increase from $Z_1$, $Z_2$, $Z_3$. . . $Z_n$ where $Z_n$ is approximately equal to the waveguide's impedance $Z_c$. By carefully matching each of the components the insertion losses are kept very low.

The parasitic resonant cavity 60 inside the waveguide is shown as a separate RLC circuit that is coupled to the transition. Its resistance represents power lost through cracks in the waveguide or to heating the substrate and dielectric. The cavity's reactance is adjusted by trimming the tuning stub so that its resonant frequency can be moved outside the desired bandwidth, thus reducing any interference with efficient circuit operation.

Figure 7:
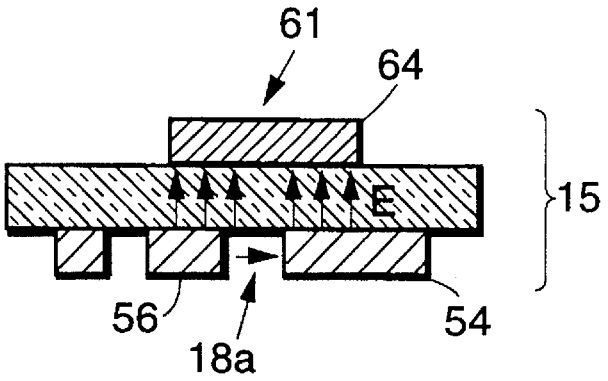
FIG. 7 is a sectional view taken along section line 7—7 of FIGS. 3 and 4, illustrating the orientation of the signal currents and electric fields.
Figure 8:
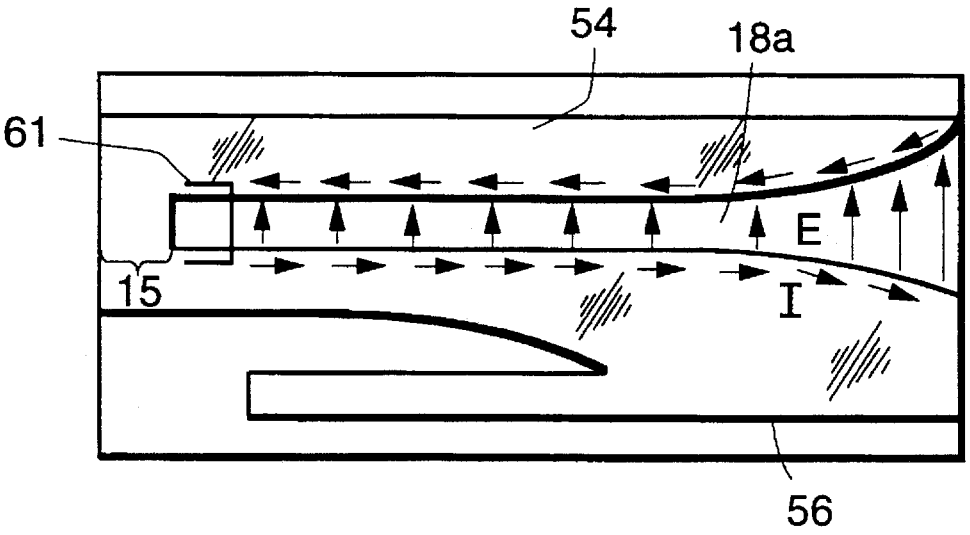
FIG. 8 is a plan view of the transmission line-to-waveguide transition with the U-shaped conductor on the transition's backside shown in the foreground to illustrate the flow of the signal currents and electric fields.

FIG. 7 is a sectional view and FIG. 8 is a plan view of the transition 10*a* with the U-shaped conductor 61 on the transition's backside shown in the foreground to illustrate the flow of the signal currents and electric fields. On either side of slotline 18*a* the electric fields, switching at the signal frequency, propagate along the microstrip 15 defined by the U-shaped conductor 61 and conductors 54 and 56. Where the conductor 61 traverses the slotline, the microstrip is interrupted and the current flowing through the U-shaped conductor is coupled onto the slotline 18*a*. Equal and opposite currents flow down either side of the slotline towards the waveguide, causing the electric field E to propagate down the flared slotline. The signal on the slotline is capacitively coupled to the inner walls of the waveguide.

Figure 9:
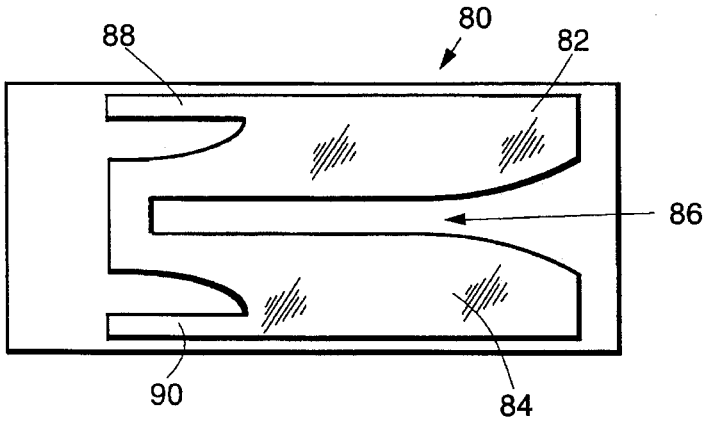
FIG. 9 is a top plan view of an alternative transmission line-to-waveguide transition embodiment for bi-directionally coupling microwave signals to a symmetric waveguide.

FIG. 9 is a top plan view of an alternate embodiment of a symmetrical transition 80 for bi-directionally coupling microwave signals to a symmetric waveguide. The transition includes symmetric conductors 82 and 84 that form an exponentially flared slotline 86 and a pair of trimmable tuning stubs 88 and 90. A single transition can be used to bi-directionally couple signals between a symmetric waveguide and a transmission line.

The transmission line-to-waveguide transition described is compact, as small as 0.2 wavelengths in diameter, and has relatively low insertion losses due to the impedance matching provided by the quarter-wave transformer, tapered slotline and tapered dielectric insert. The trimmable tuning stub increases the transition's bandwidth to approximately 20% of the center frequency, as compared to 10%–15% for previous designs. The transition's design and manufacturing is simplified and cost reduced by spacing the slotline inward from the waveguide walls. The transition's impedance is easier to compute, which simplifies its design. The transition is inserted into the waveguide without an internal connection, thus avoiding the prior art need to weld the transition to the waveguide. Because the heating associated with welding is avoided, the waveguide can be a plastic sleeve that is plated with a conductive surface, which is cheaper and lighter weight than a solid metal waveguide.

While several illustrative embodiments of the invention have been shown and described, numerous variations and alternate embodiment will occur to those skilled in the art. Such variations and alternate embodiments are contemplated, and can be made without departing from the spirit and scope of the invention as defined in the appended claims.

We claim:

1. An end-on transmission line-to-waveguide transition, comprising:

a substrate that has a slotline side and a traversing side and opposing edges;

a slotline conductor disposed on the slotline side of said substrate that defines a flared slotline having a flared gap, said flared gap having a width, said conductor being spaced inward from the opposing edges of the substrate;

a traversing conductor disposed on the traversing side of said substrate that is aligned with said slotline conductor and traverses the flared gap in said slotline; and a trimmable tuning stub disposed on the slotline side of said substrate, adjacent to and in electrical contact with said slotline conductor for adjusting a resonant frequency for said transition.

2. The transition of claim 1 wherein said slotline has an impedance that increases with the width of the flared gap, further comprising a transmission line having a characteristic impedance, said slotline conductor and said traversing conductor being connected to respective contacts of the transmission line to match said transmission line's characteristic impedance to the impedance of the slotline where said traversing conductor crosses the flared gap in the slotline.

3. The transition of claim 2, wherein said transition responds to signals over a bandwidth which is centered about a center wavelength, said traversing conductor having a length, the length of said traversing conductor between said transmission line and said slotline being approximately one-quarter of said center wavelength.

4. The transition of claim 1, wherein said trimmable tuning stub is a part of said slotline conductor and extends towards a closed end of the slotline leaving a gap between said closed end and the remainder of the slotline conductor.

5. The transition of claim 1, wherein said transition responds to signals over a bandwidth which is centered about a center wavelength, said traversing conductor extending approximately one-quarter of said center wavelength past said slotline and being terminated in an open circuit.

6. The transition of claim 5, wherein said slotline has a closed end that is approximately one-quarter of said center wavelength from the point at which said traversing conductor crosses the flared gap in said slotline.

7. The transition of claim 6, wherein said flared slotline has an impedance that gradually increases with the width of said flared gap to a predetermined value.

8. An end-on transmission line-to-waveguide transition for bi-directionally coupling signals, comprising:

a waveguide;

a substrate having a slotline side and a traversing side positioned inside said waveguide;

a slotline conductor disposed on the slotline side of said substrate that defines a flared slotline having a flared gap and a characteristic impedance, said slotline conductor being spaced inward from said waveguide; and a traversing conductor disposed on the traversing side of said substrate that is aligned with said slotline conductor and traverses the flared gap of said slotline; and a transmission line having a characteristic impedance and a pair of conductors that are connected to the slotline and traversing conductors for one of transmitting and receiving said signals, said traversing conductor aligned with said slotline conductor defining an impedance transformer between the traversing conductor's connection to said transmission line and said slotline to match said transmission line's characteristic impedance to the characteristic impedance of the slotline.

9. An end-on transmission line-to-waveguide transition, comprising:

a substrate that has a slotline side, a traversing side and opposing edges;

a slotline conductor disposed on the slotline side of said substrate that defines a flared slotline having a flared gap, said conductor being spaced inward from the opposing edges of the substrate; and a traversing conductor disposed on the traversing side of said substrate that is aligned with said slotline conductor and traverses the flared gap in said slotline.

10. The transition of claim 9, wherein said slotline has a closed end and an open flared end, further comprising:

a waveguide into which said substrate is disposed, said slotline and traversing conductors being respectively spaced inward from said waveguide; and a flared dielectric insert positioned in said waveguide with a closed end thereof positioned adjacent to said open end of the slotline, and an open flared end for receiving said closed end of the slotline, said slotline and traversing conductors respectively not contacting said insert.

11. An end-on transmission line-to-waveguide transition for bi-directionally coupling signals, comprising:

a waveguide;

a substrate having slotline and traversing sides positioned inside said waveguide;

a slotline conductor disposed on the slotline side of said substrate that defines a flared slotline having a flared gap, said slotline conductor being spaced inward from said waveguide; and a traversing conductor disposed on the traversing side of said substrate that is aligned with said slotline conductor and traverses the flared gap of said slotline; and a trimmable tuning stub disposed on said substrate in contact with said slotline conductor for adjusting a resonant frequency for said transition.

12. The transition of claim 11, wherein said waveguide has an open end, further comprising:

an end cap having an inner surface to which said substrate is attached, said end cap engaging the waveguide's open end to position the substrate inside said waveguide, without an internal mechanical connection between the substrate and the waveguide, so that the slotline conductor is spaced inward from the waveguide.

13. An end-on transmission line-to-waveguide transition, comprising:

a waveguide having a width;

a microstrip for electrically communicating an unbalance signal;

a slotline having a flared gap for electrically communicating a balanced signal, said slotline having a width, which is smaller than the width of the waveguide; and a balun for coupling said microstrip and said slotline so as to bi-directionally couple unbalanced-to-balanced signals.

14. An end-on transmission line-to-waveguide transition, comprising:

a waveguide;

a microstrip for electrically communicating an unbalance signal;

a slotline having a flared gap for electrically communicating a balanced signal, said flared gap and said slotline each having a respective width, width of said slotline being small enough so that insertion of said transition into said waveguide causes the slotline to be spaced inward from said waveguide; and a balun for coupling said microstrip and said slotline so as to bi-directionally couple unbalanced-to-balanced signals; and a trimmable tuning stub adjacent to and in electrical contact with said slotline for adjusting a resonant frequency for said transition.

15. The transition of claim 14, wherein said transition is coupled to a transmission line which has a characteristic impedance, said slotline having an impedance that increases with the width of the flared gap, said microstrip comprising an impedance transformer that matches the characteristic impedance of the transmission line to the impedance of the slotline.

16. The transition of claim 14, wherein said microstrip includes an open circuit quarter-wave portion and said slotline includes a short circuit quarter-wave portion that lies between a closed end of said slotline and said microstrip, said open and short circuit quarter-wave portions together defining the balun.

17. An end-on transmission line-to-waveguide transition for bi-directionally coupling signals, comprising:

a waveguide for transmitting or receiving a first signal;

a flared dielectric insert in said waveguide, a flared open end of said insert being positioned towards a first end of said waveguide;

a transmission line having a pair of conductors for transmitting or receiving a second signal;

a substrate having a slotline side and a traversing side, a back edge of said substrate being positioned inside the waveguide in the flared dielectric insert;

a slotine conductor disposed on the slotline side of said substrate that defines a flared slotline havin a flared gap, a closed end of said slotline being positioned toward the first end of said wavguide and connected to one of said transmission line's conductors;

a traversing conductor disposed on the traversing side of said substrate that is connected to said transmission line's other conductor and traverses the flared gap in said slotline to bi-directionally couple said first and second signals between said waveguide and said transmission line, said slotline and traversing conductors being spaced apart from said dielectric insert; and a trimmable tuning stub disposed on said substrate in contact with said slotline conductor for adjusting a resonant frequency for said transition.

18. The transition of claim 17, wherein said slotline and traversing conductors are spaced inward from said waveguide.

19. The transition of claim 18, wherein said waveguide has an open end, further comprising:

an end cap having an inner surface to which said substrate is attached and an outer surface through which said transmission line conductors are attached to the slotline and traversing conductors, said end cap engaging the waveguide's open end to position the substrate inside said waveguide, without an internal mechanical connection between the substrate and the waveguide, so that the slotline conductor is spaced inward from the waveguide.

20. An end-on transmission line-to-waveguide transition, comprising:

a substrate that has a slotline side and a traversing side and opposing edges;

a slotline conductor disposed on the slotline side of said substrate that defines a flared slotline having a closed end and an open flared end, said conductor being spaced inward from the opposing edges of the substrate;

a traversing conductor disposed on the traversing side of said substrate that is aligned with said slotline conductor and traverses said slotline between the closed and open ends thereof;

a waveguide into which said substrate is disposed, said slotline and traversing conductors being respectively spaced inward from said waveguide;

a flared dielectric insert positioned in said waveguide with a closed end thereof positioned adjacent to said open end of the slotline, and an open flared end for receiving said closed end of the slotline, said slotline and traversing conductors being spaced apart from said insert; and a coaxial cable having a center conductor and an outer conductor, said center conductor being connected to said traversing conductor and said outer conductor being connected to said slotline conductor such that said traversing conductor bi-directionally couples signals between said coaxial cable and said waveguide.

21. An end-on transmission line-to-waveguide transition for bi-directionally coupling signals, comprising:

a waveguide having walls separated by a predetermined inner dimension;

a substrate having a slotline side and a traversing side;

a slotline conductor disposed on the slotline side of said substrate defines a flared slotline having a flared gap, said slotline conductor having a width which is smaller than said inner dimension; and a traversing conductor disposed on the traversing side of said substrate that is aligned with said slotline conductor and traverses the flared gap of said slotline; and an end cap, to which said substrate is attached, that engages an open end of said waveguide to position the substrate inside said waveguide so that the slotline conductor is spaced inward from the waveguide walls.

22. The transition of claim 21, wherein said slotline has a closed end, further comprising:

a flared dielectric insert positioned in said waveguide, said closed end of the slotline being positioned in a flared end of said insert so that the slotline and traversing conductors respectively do not contact the insert.

* * * * *

UNITED STATES PATENT AND TRADEMARK OFFICE

CERTIFICATE OF CORRECTION

PATENT NO : 5,600,286

DATED : February 4, 1997

INVENTOR(S) : Stan W. Livingston and Jar J. Lee

It is certified that error appears in the above-identified patent and that said Letters Patent is hereby corrected as shown below:

At column1, line 6, insert the following as the first paragraph a[illegible] he heading BACKGROUND OF THE INVENTION:

-- This invention was made with Government support un[illegible] ntract Number DASG60-92-C-0212 awarded by the Department of the An[illegible]. The Government has certain rights in this invention. --

Signed and Sealed this

Fourth Day of January, 2000

*Attest:*

*Attesting Officer*

*Acting Commissioner of Patents and Trademarks*